US006237156B1

(12) United States Patent
Ellman et al.

(10) Patent No.: US 6,237,156 B1
(45) Date of Patent: May 29, 2001

(54) VISOR FOR A BASEBALL CAP

(75) Inventors: Louis Ellman, 221-23 64th Ave., Bayside, NY (US) 11364; Neil Ellman, Queens, NY (US)

(73) Assignee: Louis Ellman, Bayside, NY (US)

( * ) Notice: Subject to any disclaimer, the term of this patent is extended or adjusted under 35 U.S.C. 154(b) by 0 days.

(21) Appl. No.: 08/997,179

(22) Filed: Nov. 28, 1997

Related U.S. Application Data

(63) Continuation of application No. 08/687,982, filed on Jul. 29, 1996, now abandoned.

(51) Int. Cl.[7] ..... A42B 1/00

(52) U.S. Cl. ..... 2/195.1; 2/10; 2/175.1; 2/209.11; 40/329

(58) Field of Search ..... 2/10, 12, 175.1, 2/195.1, 209.11, 209.13, 209.12; 40/329

(56) References Cited

U.S. PATENT DOCUMENTS

| | | | | |
|---|---|---|---|---|
| 901,320 | * | 10/1908 | Bruzaud | 2/10 |
| 1,538,847 | * | 5/1925 | Wheeler | 40/329 |
| 4,096,589 | | 6/1978 | Goldstein . | |
| 4,918,759 | * | 4/1990 | Anderson et al. | 2/209.13 |
| 5,233,703 | * | 8/1993 | Galka | 2/209.13 |
| 5,410,761 | * | 5/1995 | Connelly et al. | 2/195.1 |
| 5,556,135 | * | 9/1996 | Duncan | 283/48.1 |
| 5,669,071 | * | 9/1997 | Vu | 2/10 |

* cited by examiner

*Primary Examiner*—John J. Calvert
*Assistant Examiner*—Katerine Moran
(74) *Attorney, Agent, or Firm*—Lackenbach Siegel Marzullo Aronson & Greenspan

(57) ABSTRACT

An adjustable visor (40) having the means for adjustment built into the visor (40) enabling the wearer of the cap (44) to change the angle of the visor (40) to a multitude of positions by means of a hinge (20) without requiring detaching the visor (40) from the cap (44).

6 Claims, 10 Drawing Sheets

VISOR FOR A BASEBALL CAP

This application is a continuation, (Rule 62), of application Ser. No. 08/687,982, filed on Jul. 29, 1996, now abandoned.

BACKGROUND—FIELD OF INVENTION

This invention relates to headgear, specifically to the visor portion of a baseball cap.

BACKGROUND—DESCRIPTION OF PRIOR ART

When one wishes to adjust the position of the visor of a cap such as a baseball cap, one has to bend the visor in an upward direction which results in distorting the shape of the visor and the visor does not stay secure in the intended position. The prior art has made attempts to solve this problem but the results have produced visors that require detaching and reattaching of the visor element from the cap portion in order to achieve the desired angle of the visor.

U.S. Pat. No. 4,096,589 to M. Goldstein (1978) discloses an adjustable visor element that must be detached and reattached in order to change the visor to the desired angle. Although the Goldstein visor in the Goldstein patent can achieve various angles, it does not afford the wearer of the cap a means to adjust the visor as the need arises without (a) taking off the cap;

(b) detaching the visor;

(c) positioning the visor on the cap by use of hook and loop fasteners; and (d) putting the cap on to see if the new position is satisfactory.

If when putting the cap back on, the wearer is not comfortable with the new position, the wearer would have to again remove the cap, detach the visor, reconnect the visor and again try the cap on in order to see if the desired angle has been achieved.

OBJECTS AND ADVANTAGES

Accordingly, several objects and advantages of the present invention are:

(a) to provide an adjustable visor that allows the wearer to change the angle of the visor to a multitude of positions without requiring detaching of the visor element from the cap portion.

(b) to provide a visor that has the means for adjusting the visor built into the visor.

(c) to provide a visor that uses a hinge(s) as the means to adjust the visor to a multitude of positions.

(d) to provide a visor that enables the wearer to adjust the angle of the visor while still wearing the cap.

Further objects and advantages are to provide a visor that allows the wearer to achieve a multitude of angles without any need to detach the visor from the cap portion.

DRAWING FIGURES

In accordance with the above description, which will become apparent hereinafter, the instant invention will now be described with reference to the accompanying drawings in which.

Figure 5:
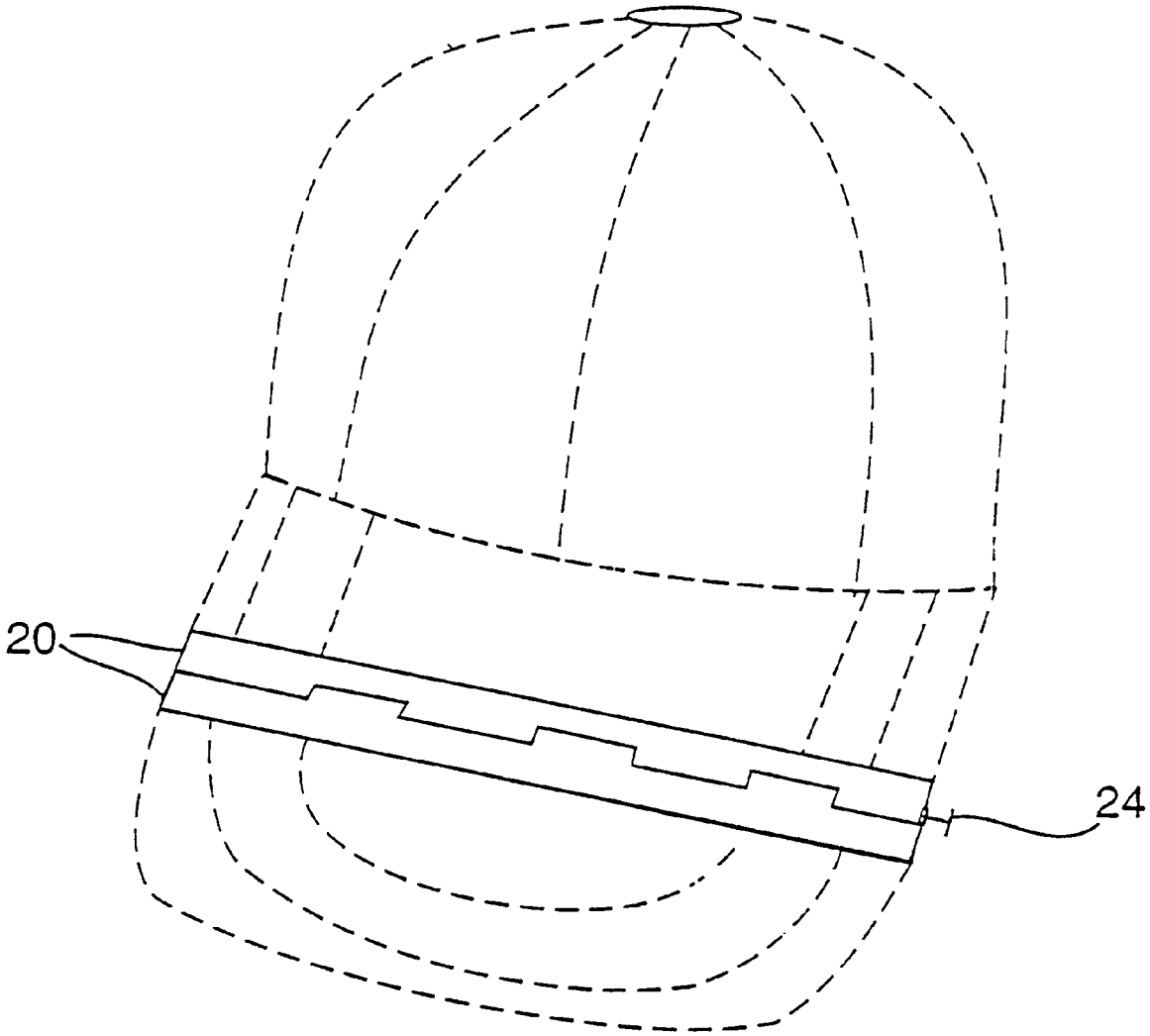

FIG. 5. is a top-side elevational view of the hinge by itself

Figure 6:
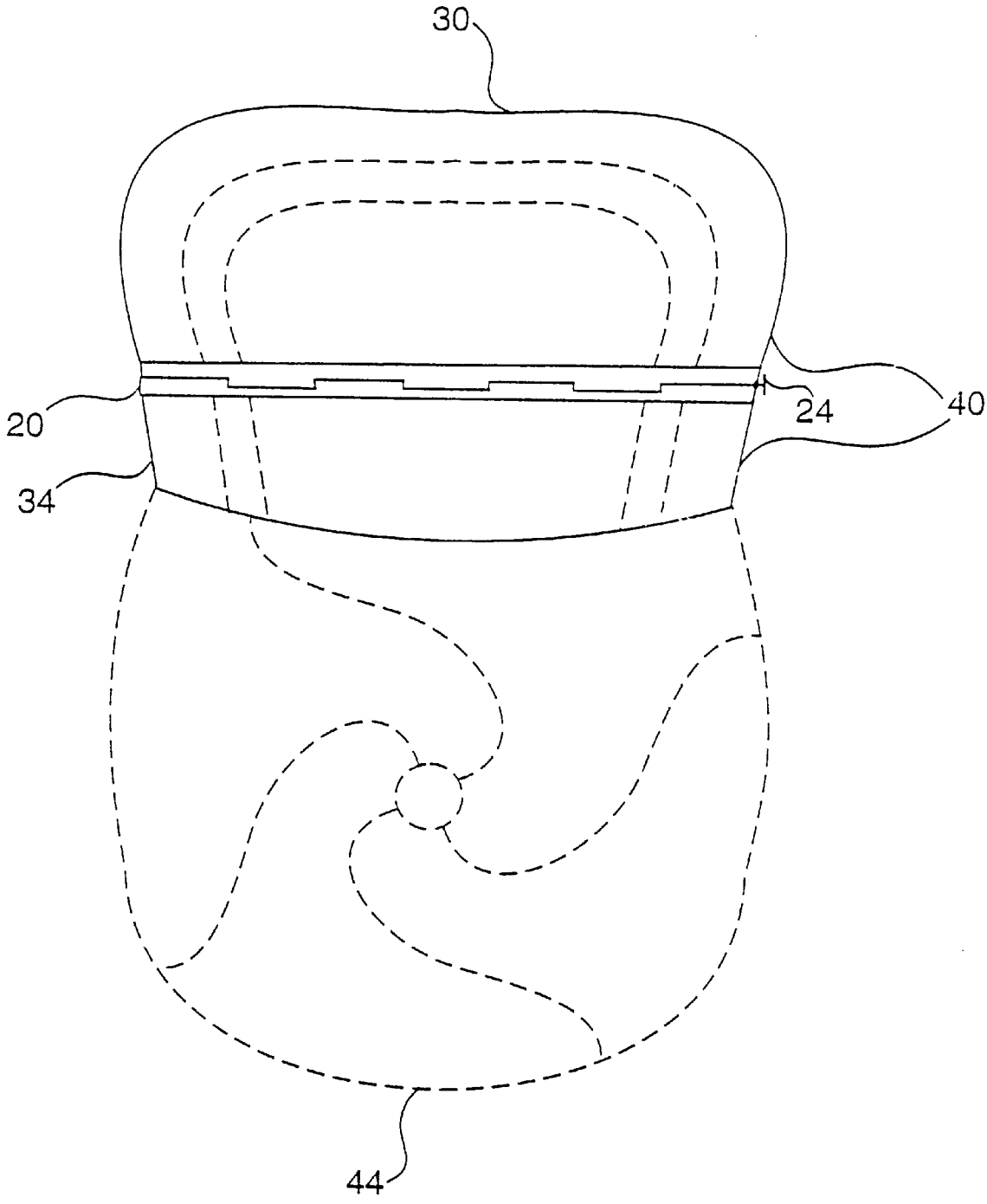

FIG. 6. is an underside view of the visor and built-in hinge connected to a standard baseball cap.

Figure 7:
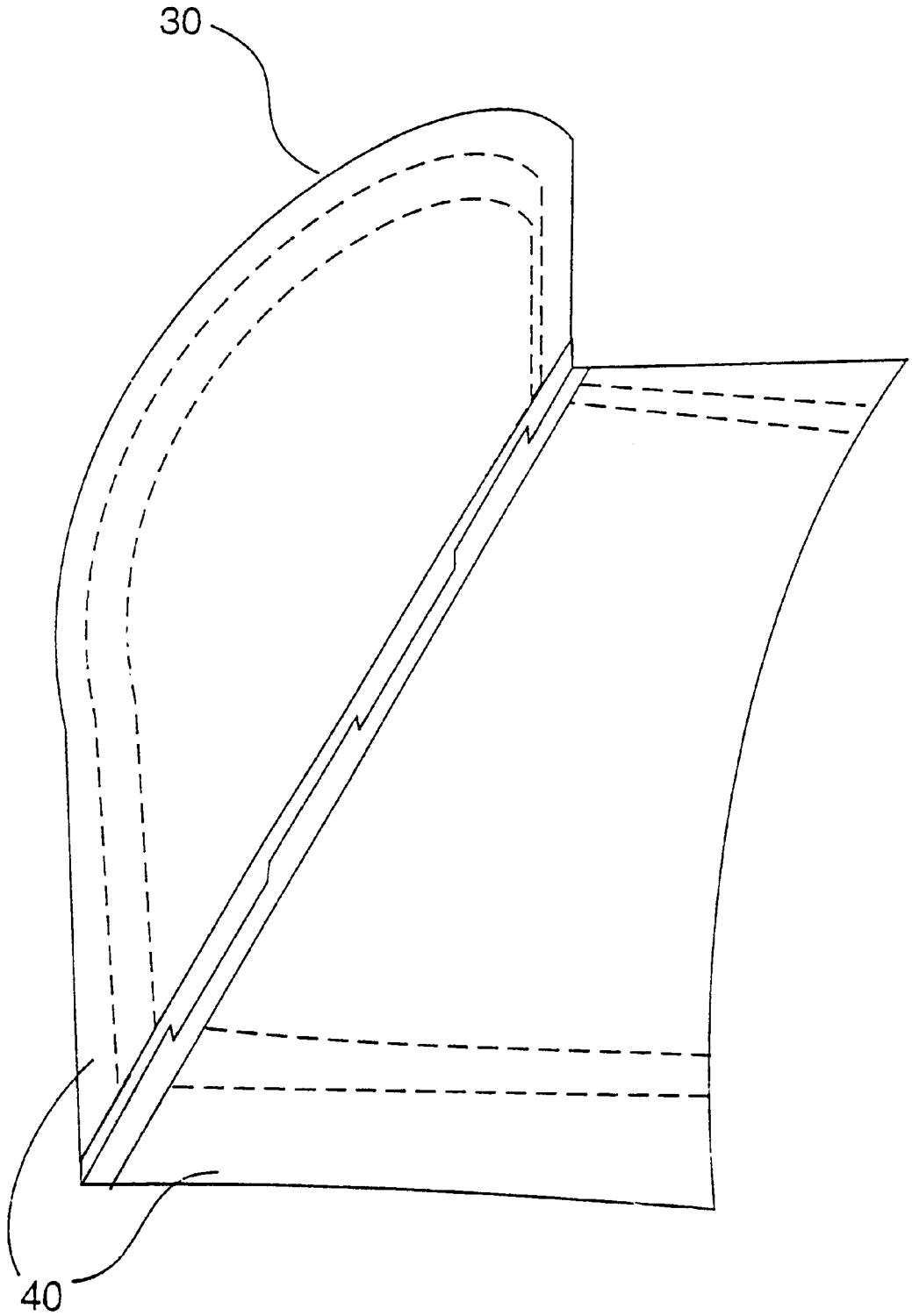

FIG. 7. is a top-side elevational side view of the visor and built-in hinge connected to a standard baseball cap and positioned at a 90 degree angle.

Figure 8:
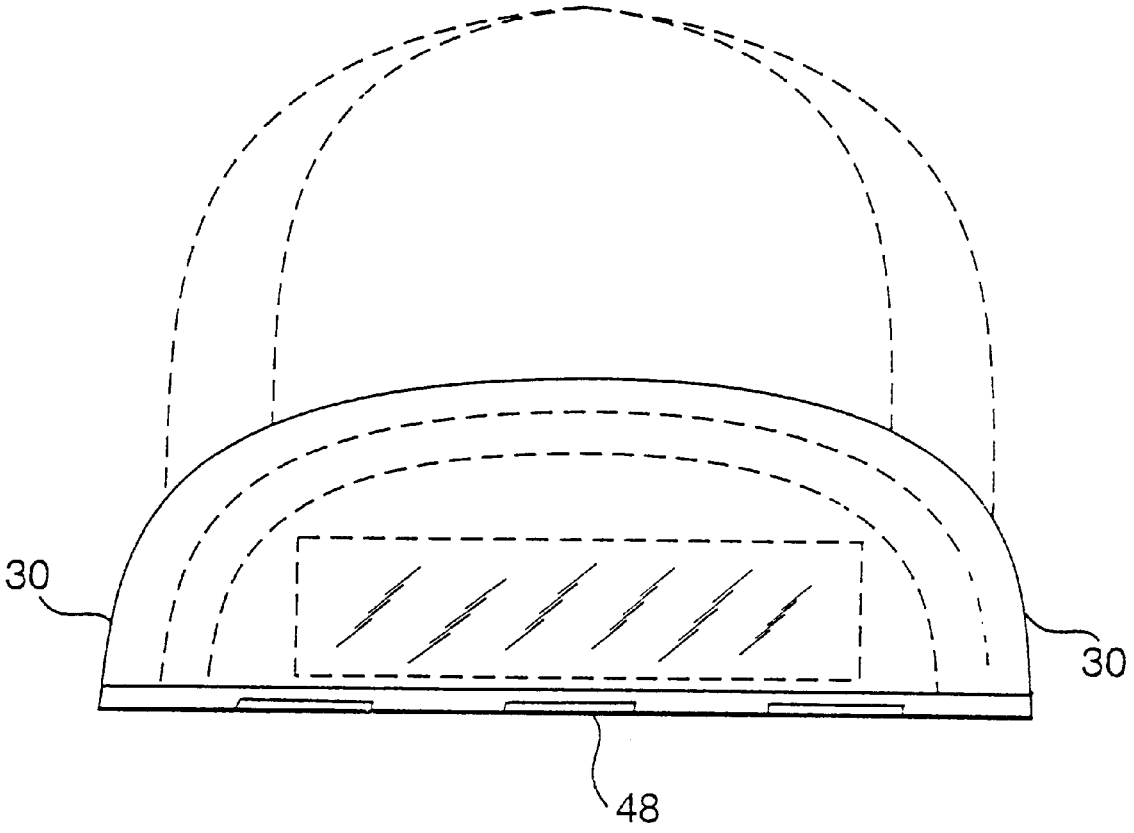

FIG. 8. is a frontal elevational view showing the visor and built-in hinge in a 90 degree angle showing reflective device attached to area for logo attachment and attached to the standard baseball cap.

Figure 9:
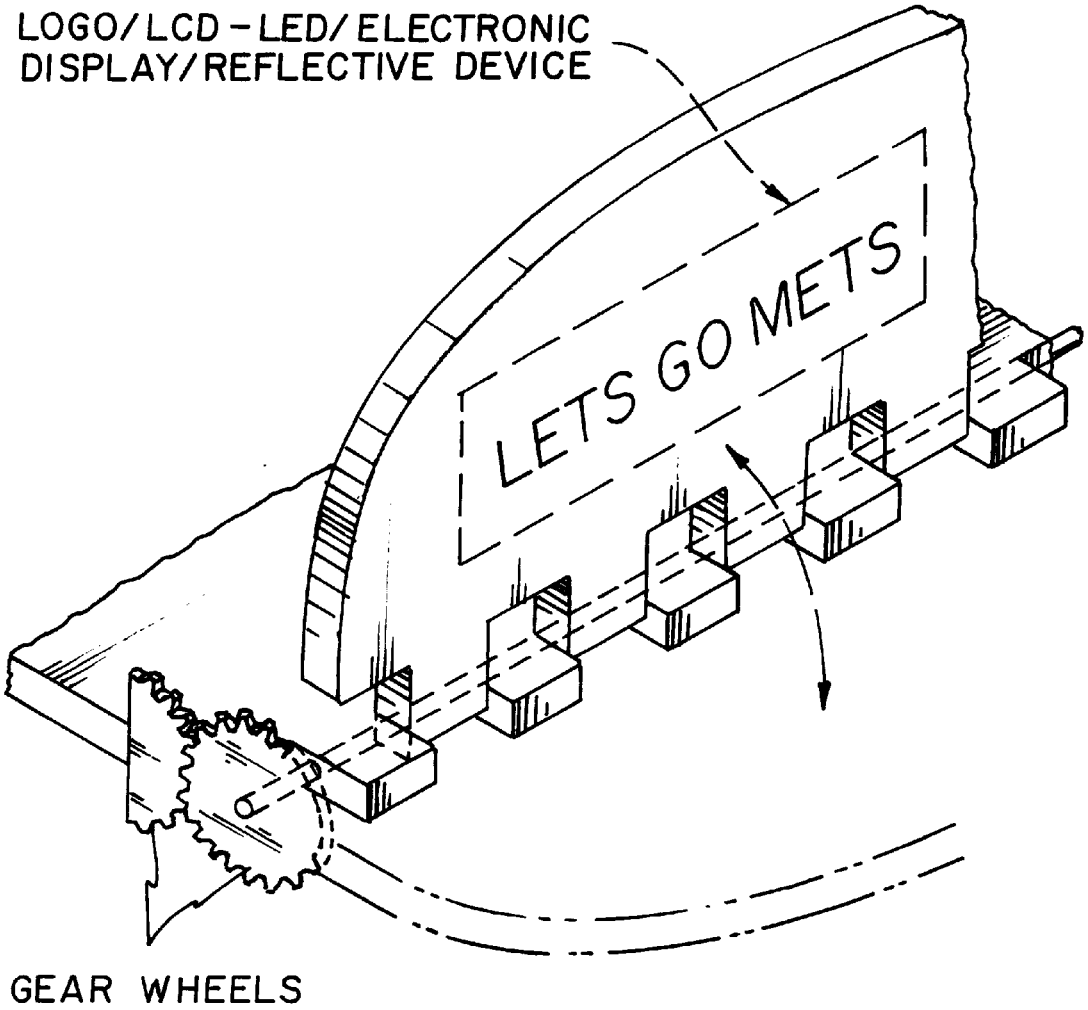

FIG. 9 is a fragmentary perspective view illustrating a bill having front and rear portions which rotate relative to each other by means of gearing elements.

Figure 10A:
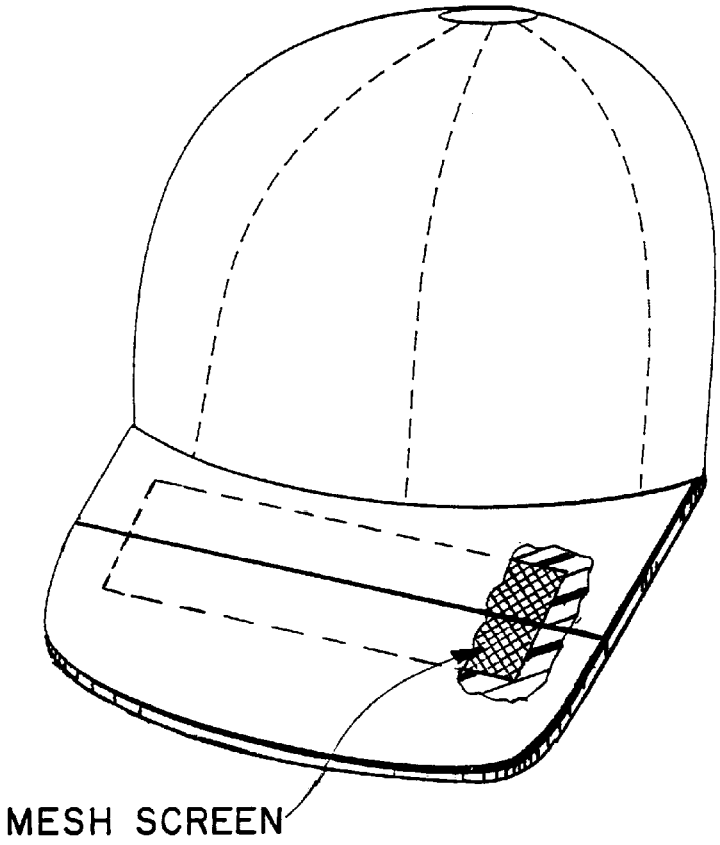
Figure 10B:
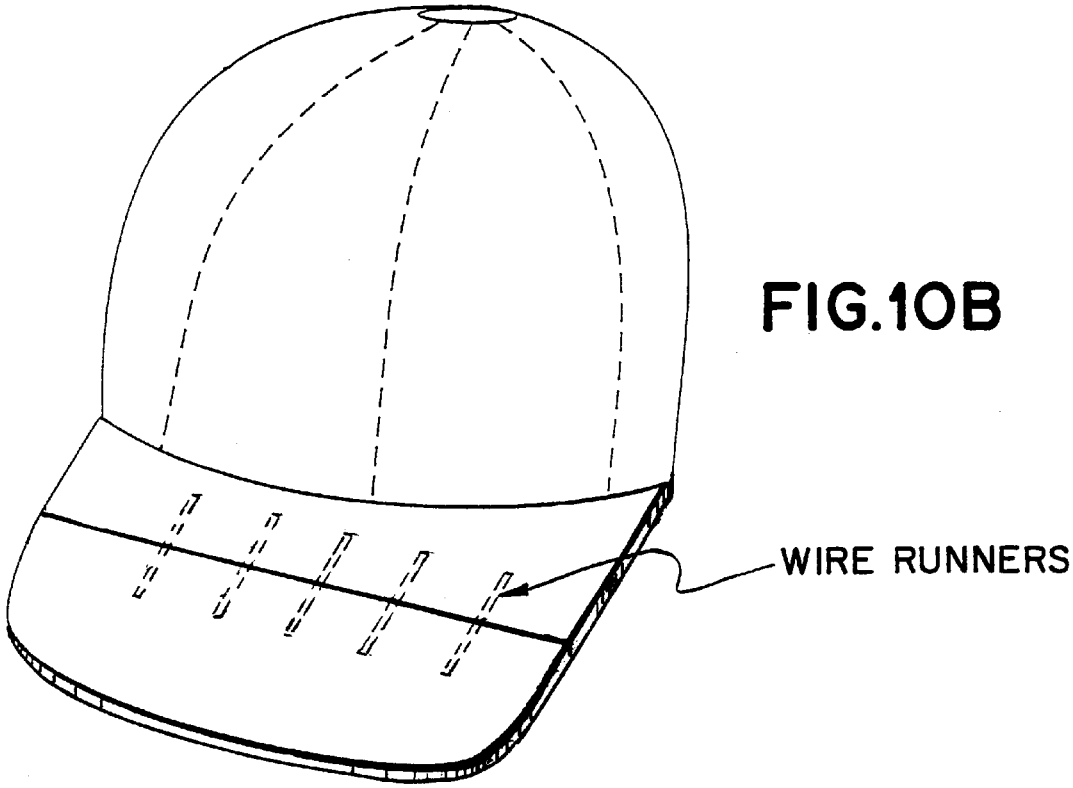

FIGS. 10A and 10B are views of a cap showing bills with front and rear portions secured together by a mesh screen or wire elements, both of which allow for rotation of the front portions.

REFERENCE NUMERALS IN DRAWINGS

| | | | |
|---|---|---|---|
| 20 | Represents the hinge in its entirety. | 24. | Pin for hinge. |
| 20A | Portion of hinge connected to frontal portion of visor. | 20B | Portion of hinge connected to back portion of visor. |
| 30 | Frontal portion of visor | 34 | Back portion of visor connected to cap. |
| 40 | Represents the visor in its entirety. Entirety meaning frontal portion of visor, part of hinge connected to back portion of visor, pin connecting two separate portions of hinge and back portion of visor connected to cap portion of cap. | 44. | Cap portion of the baseball cap. |
| | | 48. | Area for logo attachment. |

SUMMARY

An adjustable visor for a baseball cap that employs a hinge as the means of adjustment, thus allowing the wearer of the cap to adjust the visor to a multitude of angles without having to detach the visor from the cap portion.

Main Embodiment Description

Description—FIGS. 1 to 10

Figure 1:
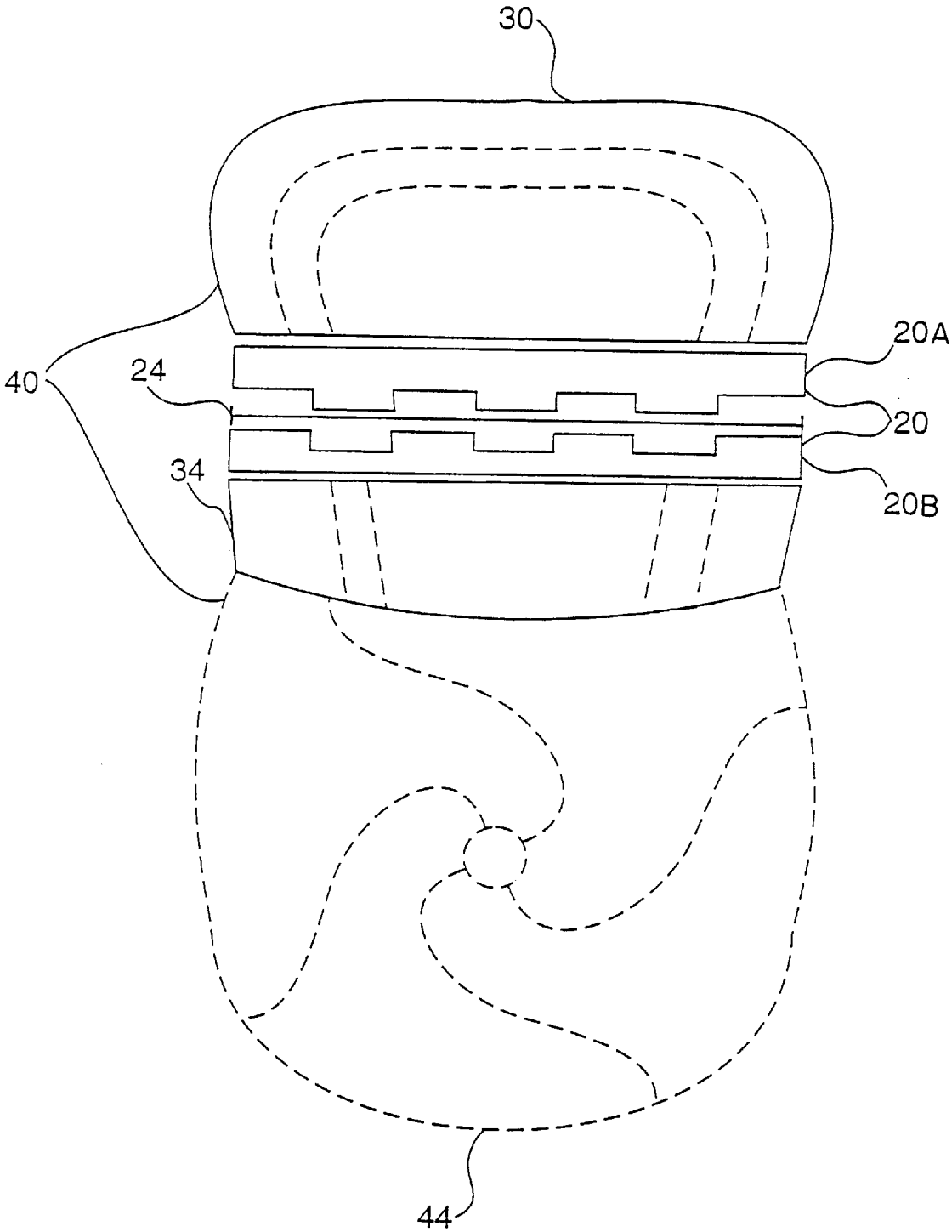
FIG. 1 is an underside exploded view of the visor, built-in or unitary hinge, and standard baseball cap.

Referring to the drawings, wherein like reference characters designate like or corresponding parts throughout the several views and referring particularly to FIG. 1, it is seen that the invention comprises a modification of a cap visor, particularly for that of the baseball cap.

FIG. 1 is an underside exploded view of the visor designated by numeral 40, the frontal portion of the visor designated by numeral 30, separated built in hinge, where the portion of the hinge connected to the frontal portion of the visor 30 is designated by numeral 20A and the portion of the hinge connected to the back portion of the visor designated by numeral 34 is designated by numeral 20B, the pin to hold the hinge together designated by numeral 24, and finally the cap portion of the cap designated by numeral 44.

Figure 2:
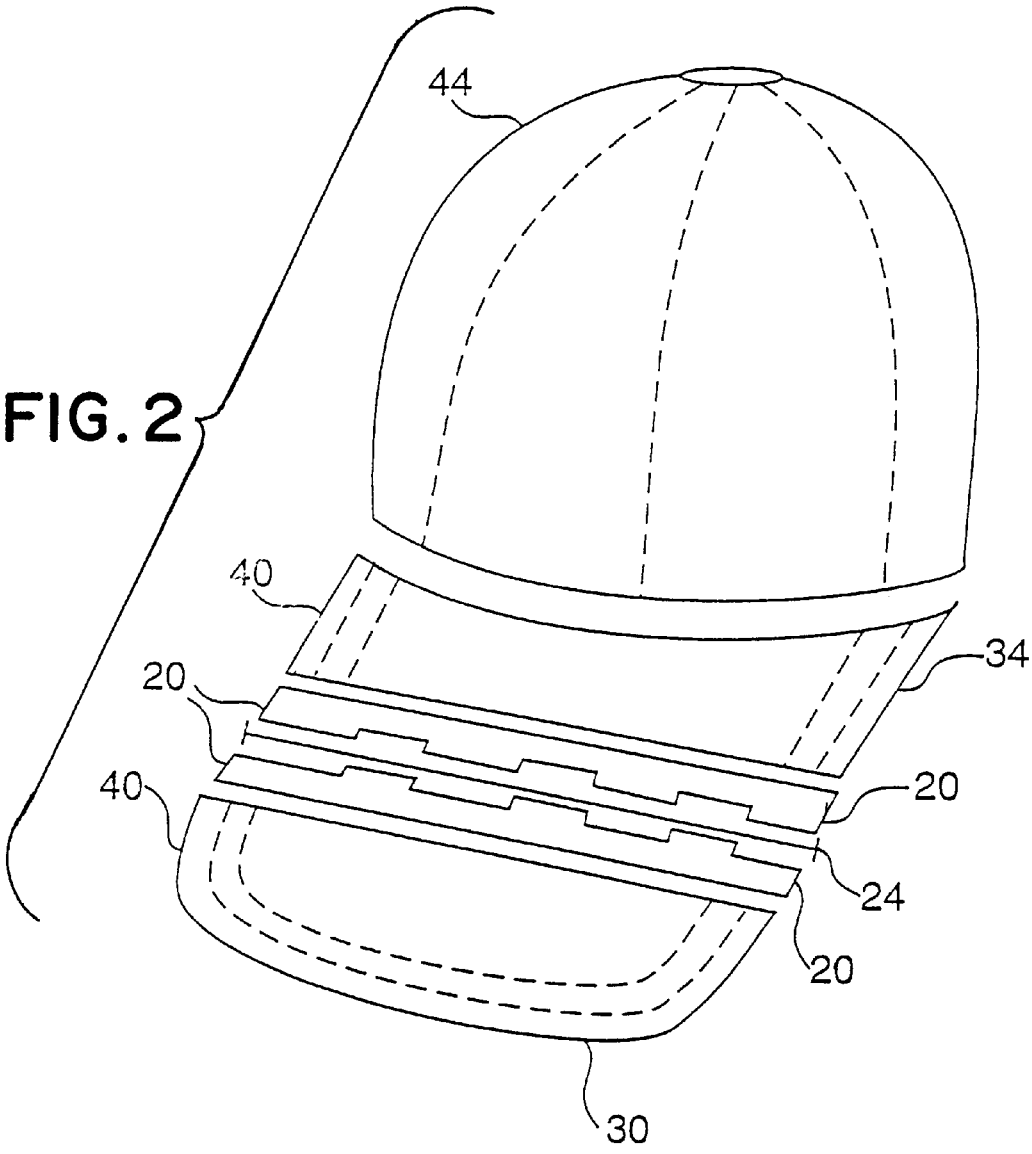
FIG. 2 is a top-side exploded view of the visor, built-in hinge and standard baseball cap.

FIG. 2 shows a top-side exploded view of the visor 40, the frontal portion of the visor, 30, separated built-in hinge 20, back portion of the visor 34 and finally the cap portion of the baseball cap 44.

Figure 3:
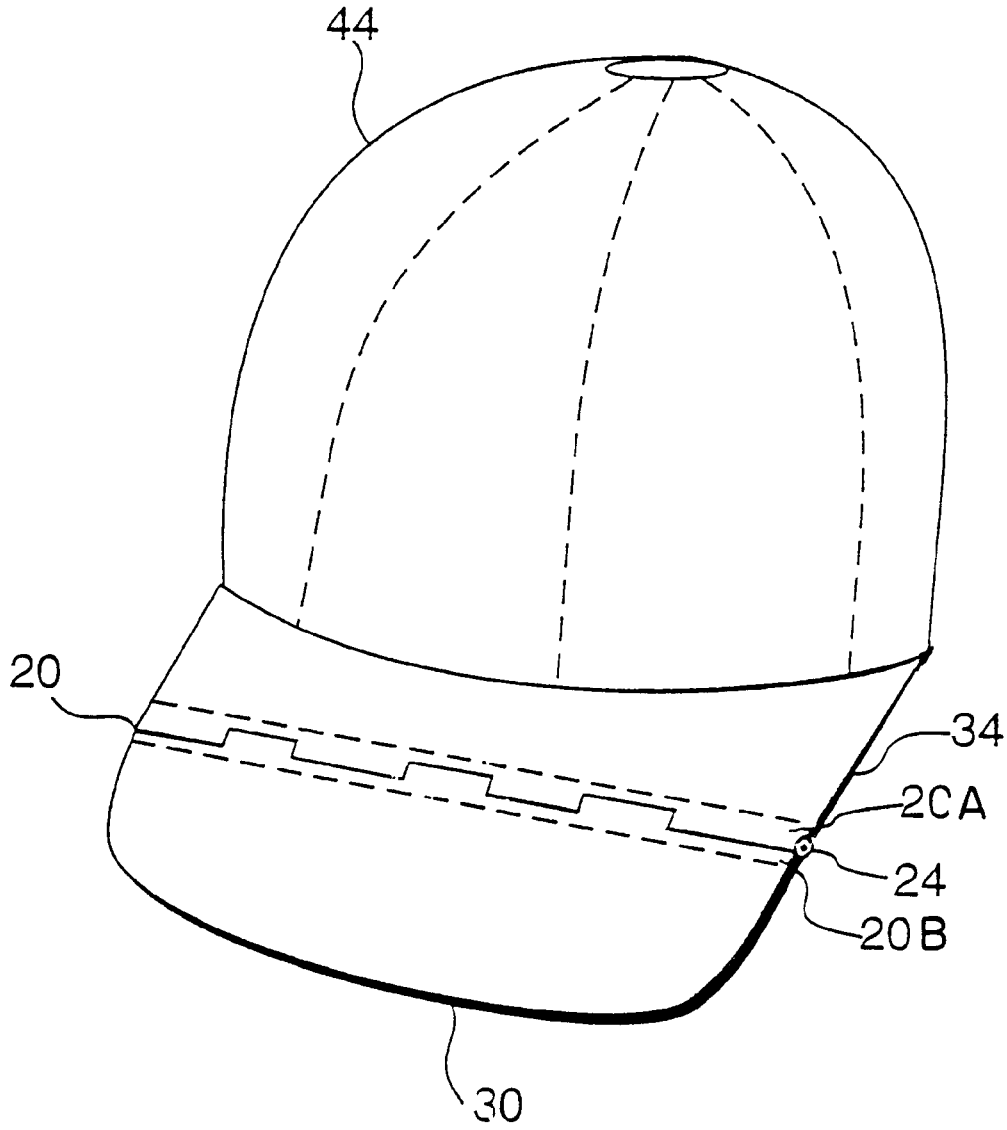
FIG. 3 is a top-side elevational view of the visor and built-in hinge connected to a standard baseball cap.

FIG. 3 shows the hinge 20 is connected by means of a pin 24. The frontal portion of the visor 30 is connected to one portion of the hinge 20A and the back portion of the visor 34 supports the other portion of the hinge 20B and is connected to the cap portion of the baseball cap 44. This figure also shows another movable bill portion 30' which, if desired, may be used in place of the original movable bill (frontal portion of the visor 30) by simply removing hinge pin 24 and exchanging bill portion 30' for bill portion 30.

Figure 4:
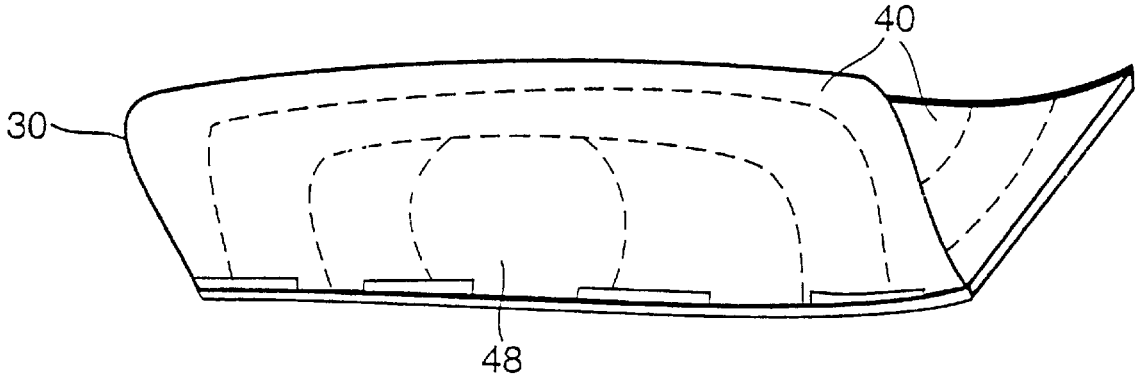
FIG. 4 is a frontal elevational view showing the visor and built-in hinge in a 45 degree angle, exposing the area for logo attachment and attached to the standard baseball cap.

FIG. 4 shows a frontal elevational view of the visor 40 where the frontal portion of the visor 30 is positioned in a 45 degree angle revealing an area for logo attachment designated by numeral 48.

FIG. 5 shows a top-side elevational view of the hinge 20 by itself connected by means of a pin 24 which runs through the length of the hinge 20.

FIG. 6 shows an underside view of the visor 40 whereby the hinge 20 is connected by means of a pin 24. The frontal portion of the visor 30 is connected to one portion of the hinge 20A and the back portion of the visor 34 supports the other portion of the hinge 20B and is connected to the cap portion of the baseball cap 44.

FIG. 7 shows a top-side elevational side view of the visor 40 whereby the frontal portion of the visor 30 is positioned at a 90 degree angle.

FIG. 8 shows a frontal elevational view showing the frontal portion of the visor 30 at an angle of 90 degrees revealing the logo attachment area 48 covered by reflective device for night time use. FIG. 9 shows in perspective front and rear portions of the bill embodying gears or gearing means so as to enable the bill to retain an angle it is positioned to when "bent" or rotated from a straight flat position to an angular up or down position.

FIGS. 10A and 10B show in perspective alternate cap constructions wherein either a series of flexible wires or a pliable mesh screen are mounted in the front and rear portions of the bill so as to enable the front portion of the bill to be "bent" up or down and be retained in place as bent.

Additional Embodiments Relating to Angle Adjustment

In addition to an edge of the preferred embodiment, the following embodiments are also mentioned as to an adjacent edge of methods to achieve angle adjustment of the visor.

(a) A set of hinges or a series of hinges positioned along the width of the visor and capable of retaining the angle it is positioned to.

(b) A pliable mesh screen spanning the width of the visor and capable of retaining the angle it is positioned to, connected to the frontal portion of the visor as well as the back portion of the visor.

(c) A series of wire runners spanning the width of the visor and capable of retaining the angle it is positioned to, whereby the wire runners are connected to the frontal portion of the visor as well as the back portion of the visor.

(d) A visor having the frontal portion and rear portion connected by means of material, wire, or other connecting device, whereby gear wheels positioned on either side of the visor, made to accommodate a multitude of increments allows the wearer of the baseball cap to adjust the visor to the desired angle as best shown in FIG. 9.

(e) A visor composed of a pliable material, either in whole or in part, that allows the wearer the ability to adjust the visor to the intended position by bending the visor into place as best shown in FIGS. 10A and/or 10B.

Additional Embodiments Relating to the Underside of the Visor (a) The area for logo attachment can support a logo, saying, picture or hologram which can be attached by means of snaps, hook and loop fasteners, velcro or clear plastic pocket where the insert may be inserted in, giving the wearer of the cap the ability to display a second logo saying or picture that is different from the one currently being displayed on the cap portion 44 itself If the display on the logo attachment area on the underside of the visor is of a permanent nature, this would be accomplished by use of stitching, glue or iron-on-backing.

(b) A light emitting device affixed to the logo attachment area that would flash each time the visor is positioned to a 90 degree angle, completing the electrical circuit. This can be used as a portable morse code or other communication message system.

(c) An LCD or electronic display affixed to the logo attachment area that could be programmable for use in displaying a team logo, a saying such as "Let's Go Mets" (as best shown also in phantom in FIG. 9 along with an area shown in phantom where such LCD or other electronic display or logo may be suitably affixed), or an advertisement such as "Eat at Joe's".

Additional Embodiments Relating to Detachable Frontal Portion of Visor (a) In this embodiment, the wearer would still have the benefit of the main embodiment being the ease in adjusting the angle of the visor. This embodiment would simply allow for the frontal portion of the visor to be removed and replaced by another frontal portion of a different color, material or design at the whim of the wearer. This would be achieved by removing the pin or other connecting device for the two sections of the visor and then reconnecting the new frontal portion of the visor to the connecting device. This would also allow the user to change at the same time what is being displayed on the logo attachment are on the underside of the visor.

Summary Ramifications and Scope

From the description above, a number of advantages of my adjustable visor become evident.

(a) This design allows the wearer of cap hat to adjust the visor to a multitude of angles without having to remove the cap.

(b) This design further eliminates the necessity to disengage the visor element from the cap and re-attach the visor to the cap each time the wearer of the cap wishes to change the angle of the visor.

(c) This design affords the wearer the opportunity to display an alternative logo, saying, picture, reflective device or hologram on the underside of the visor by means of snaps, velcro (and loop fastener), clear plastic pocket or stitching.

Accordingly, the reader will see that the adjustable visor of this invention gives the wearer of the cap the convenience of being able to adjust the visor to the angle of the wearer's choice without having to remove the visor from the cap itself.

Furthermore, the adjustable visor described herein has additional advantages in that this design, having the means for adjustment built into the visor provides a method of angle adjustment that does not alter the basic design of the cap and affords an added convenience without requiring any extra effort on the part of the wearer. Besides providing ease of adjustment, this design will support logos, sayings, designs, reflective devices and holograms that can be attached to the underside of the visor and displayed by simply positioning the visor at a 90 degree angle.

Although the description above contains a number of specificities, these should not be construed as limiting the scope of the invention but as merely providing illustrations of some of the presently preferred embodiments of this invention. For example, the visor can be segmented into three parts thereby allowing the 3 visor sections to operate independently of one another.

Thus the scope of the invention should be determined by the appended claims and their legal equivalents, rather than by the examples given.

What is claimed is:

1. A visor/bill for a cap, such as a baseball/golf cap having a projecting bill comprising:

a back or fixed bill portion secured to said cap, and a movable bill portion pivotally connected to said fixed bill portion, and capable of rotational adjustment for positioning said movable bill portion to a plurality of angular positions relative to said fixed bill portion;

said fixed and movable bill portions of said baseball/golf cap each having a mating edge, and said mating edges being connected together by means of a hinge so as to enable angle adjustment with respect there between, and said movable bill portion pivoting along said hinge and about said fixed bill portion;

said hinge enabling said movable bill portion to pivot in angular increments up to an angle 90° with respect to a plane through said fixed bill portion;

gearing elements on said fixed and movable bill portions for varying/changing said visor/bill's appearance by angularly adjusting the position of said movable bill with respect to said fixed bill; and;

means for attaching on said movable bill for securing thereto another item selected from the group consisting of a logo, a picture, an emblem, an LCD, an LED and combinations thereof; wherein said means for attaching is selected from the group consisting of snaps, hook and loop fasteners, a pocket and combinations thereof.

2. The visor/bill according to claim 1, wherein said gearing elements provide a multitude of increments so as to enable a wearer of said cap to adjust said movable bill portion to a desired angle.

3. The visor/bill according to claim 2, wherein said angular position is anywhere from about 0° to about 90°.

4. The visor/bill according to claim 3, wherein said angle is 45°.

5. A visor/bill for a cap, such as a baseball/golf cap having a projecting bill comprising:

a fixed bill portion secured to said cap, and a movable bill portion pivotally connected to said fixed bill portion, and capable of rotational adjustment for positioning said movable bill portion to a plurality of angular positions relative to said fixed bill portion;

said fixed and movable bill portions of said baseball/golf cap each having a mating edge, and said mating edges being connected together by means of a series of wire runners spanning the width of said visor/bill from movable bill portion to fixed bill portion, so as to be capable of anglular adjustment with respect therebetween, and said movable bill portion pivoting along said mating edges and about said fixed bill portion.

6. A visor/bill for a cap, such as a baseball/golf cap having a projecting bill comprising:

a back or fixed bill portion secured to said cap, and a front or movable bill portion pivotally connected to said fixed bill portion, and capable of rotational adjustment for positioning said movable bill portion to a plurality of angular positions relative to said fixed bill portion;

said fixed and movable bill portions of said baseball/golf cap each having a mating edge, and said mating edges being connected together by means of a pliable mesh screen spanning the width of said visor/bill from movable bill portion to fixed bill portion, so as to enable angular adjustment with respect therebetween, and said movable bill portion pivoting along said mating edges and about said fixed bill portion.

* * * * *